United States Patent [19]

Chen et al.

[11] 4,352,572

[45] Oct. 5, 1982

[54] CONTINUOUS AND AUTOMATIC OIL-WATER MIXING METHOD AND ITS INSTALLATION

[75] Inventors: Hwang-Chuan Chen, No. 19, 2nd Fl. Lane 282 Min Tsu West Rd.; Peter E.P. Jih, both of Taipei, Taiwan

[73] Assignee: Hwang-Chuan Chen, Taipei, Taiwan

[21] Appl. No.: 169,084

[22] Filed: Jul. 15, 1980

[30] Foreign Application Priority Data

Jan. 9, 1980 [TW] Taiwan ..... 6910049

[51] Int. Cl.[3] ..... B01F 3/08

[52] U.S. Cl. ..... 366/145; 366/148; 366/177; 366/336; 366/338; 366/340; 431/4

[58] Field of Search ..... 366/336, 337, 338, 340, 366/144, 145, 148, 177; 128/25 R, 25 A, 25 B, 25 E; 431/4; 60/39.05

[56] References Cited

U.S. PATENT DOCUMENTS

| | | | |
|---|---|---|---|
| 3,582,048 | 6/1971 | Sarem | 366/340 |
| 3,738,615 | 6/1973 | Brasie | 366/336 |
| 3,782,694 | 1/1974 | Shano | 366/340 |
| 4,293,230 | 10/1981 | Tan | 366/338 X |

*Primary Examiner*—Billy J. Wilhite

*Attorney, Agent, or Firm*—Robert E. Burns; Emmanuel J. Lobato; Bruce L. Adams

[57] ABSTRACT

In a method and installation for providing a stable mixture of heavy oil and water to an oil burner, heavy oil is supplied from a storage tank to an oil tank where it is maintained at a selected pressure and a temperature of 35°-45° C. Water is supplied from a water source to a water tank where it is maintained at a selected pressure and a temperature of 30°-40° C. Oil from the oil tank and water from the water tank are pumped into and through an agitator at a pressure of 3.5-5.5 kg/cm$^2$ while maintaining the temperature of the oil and water above 30° C. The agitator comprises a cylindrical casing containing a first set of static disc-like elements having inclined holes to produce a swirling motion of the oil-water and a second set of static disc-like elements each having a central protruding dome portion surrounded by a rim portion. Alternate elements of the second set have a multiplicity of small holes in the dome portion while intervening elements have a multiplicity of small holes in the rim portion.

14 Claims, 8 Drawing Figures

CONTINUOUS AND AUTOMATIC OIL-WATER MIXING METHOD AND ITS INSTALLATION

SUMMARY OF THE INVENTION

Experiments have confirmed the desicability of adding water to heavy oil for combustion purposes. Since water is a hydroxide, its hydrogen content has a high combustibility and its oxygen content is also good for combustion. If water is added at a proper ratio to the heavy oil to be well mixed and becomes a particle form, then, when the mixture enters into the boiler, its moisture will rapidly become vapor to increase the combustion efficiency of its oil content. According to this principle, the applicants have made many experiments and finally found that, under the control and the agitation of the method and installation of this invention, the mixture with a ratio of 80–85% heavy oil to 15–20% water will obtain the most stable agitation effect and the best combustion efficiency.

The ordinary heavy oil and water mixture is usually made by mixing the heavy oil and the water in a mixing barrel and the appliance used, is the customary mixer, for which not only the mixing speed is slow, but also the mixture's stability is poor (Here the stability means the duration period of keeping the oil-water mixture in a well mixed condition). The defect of the customary mixers is that they have no ability for continuous supply, so that the mixture must be pre-mixed in the barrel before entering into the boiler and re-mixed for a second use. However, in case the boiler can not be shut down, it is necessary to have two like equipments for alternative supply, or to feed the boiler with the pure heavy oil immediately after the mixture is consumed and wait for exchange until the mixture is mixed again. In this respect, it will certainly cause many inconveniences to the operation and also, the boiler's temperature will be hard to control. Aiming at the above mentioned problems, this invention is designed to be a continuous and integrated system for supply and conveyance, which can continuously supply an oil-water mixture at constant temperature and constant pressure, converting a complicated and interrupted operation into an automatic and continuous operation.

In order to eliminate the inconveniences incident to the oil-water mixture for boiler use that is made by the ordinary mixing methods, this invention provides an integrated system for supply and conveyance, which has the ability to automatically and continuously supply the oil-water mixture.

Another purpose of this invention is to provide a mixing method and installation, which can elevate the stability of the oil-water mixture and make the mixture in the best combustion efficiency.

Other purposes and characteristics of this invention will be found in other parts of this specification.

DESCRIPTION OF PREFERRED EMBODIMENTS

The oil-water mixing method and installation in accordance with the invention will be described as follows: First, attach the factory's water pipe and the oil pipe of the oil reservoir to the heating water tank and the supplementary oil tank of this invention separately, making the water and the heavy oil enter, at a constant pressure and temperature condition, into the mixture conveying pipe at a given ratio, then, by the operation of the pump gear, the mixture will pass through the temperature controllers for the temperature measurement. If the temperature is insufficient, the mixing stability will be hard to obtain and in this case, the temperature controller will order the micro switch on the water conveying pipe to be off, only letting the heavy oil in the oil tank pass. Since the oil is more easily heated, the temperature will be rapidly recovered and the micro switch will be turned on for continuation of water supply. The heavy oil and the water passed through the temperature controller will enter into the agitator under pressure and after well agitating by the special structural stop blades in the agitator, they will become a mixture in a completely mixed condition. As the process is continuous, there is nothing to worry about the boiler's temperature control. Further, there is a timer set on the power control system. When the whole installation shuts off in automatically, the water supply will be first cut off about 3 seconds in order not to keep too much water in the mixture pipe, otherwise, it will cause an uneven mixture when the installation starts to operate again.

Figure 1:
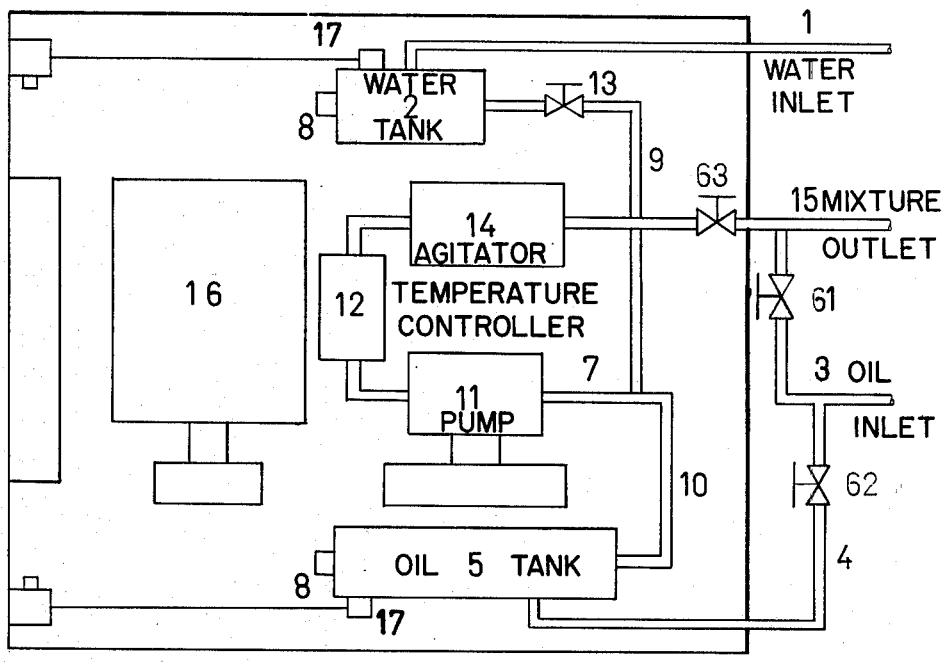
FIG. 1 is a flow chart, illustrating the method and installation system of this invention.

Herewith, the respective mechanism structures, functions, characteristics and control systems will be, accompanied by the enclosed drawings, described in detail as follows:

FIG. 1 is a flow chart indicating the successive steps of the process. The water inlet pipe (1) is a pipe connected to the factory's water source, which supplys water to the water tank (2); the water temperature is always kept between 30°–40° C. by the temperature adjuster (8). Further, a level controller (17) is set in the water tank, which will automatically close the water inlet pipe (1) upon high water level, or close the water conveying pipe (9) upon low water level. In doing so, the water in the water tank (2) will be kept at constant temperature and pressure condition. The oil inlet pipe (4) is connected to the oil tube (3) of the factory's giant oil reservoir.

Normally the control valve (61) is closed and control valve 62 is open off, letting the heavy oil enter into the oil tank (5) through the oil inlet pipe (4) when operating this invention's installation. On the occasion that this invention's installation must be repaired or maintained, the control valve (62) is closed and the heavy oil is allowed to directly enter into the oil outlet pipe (15) through the control valve (61), which will directly supply the requirement of the boiler. Since the oil tank (5) that the heavy oil enters has also a temperature adjuster (8) and a level controller (17), the temperature of the heavy oil can be kept between 35°–45° C. The reason why a level controller for the pressure adjustment and a temperature adjuster for the heating purpose are provided is to keep the oil and the water at the intake of the oil pump (11) at constant pressure (equal level) variation. Therefore, the oil and the water are controlled to be set at constant temperature (for agitation purpose) and constant pressure (making the agitation ratio stable) in order to obtain the expected effect. When the water in the water tank (2) and the heavy oil in the oil tank (5) simultaneously enter into the mixture conveying pipe (7) along the respective water conveying pipe (9) and the oil conveying pipe (10), they can easily flow to the oil pump (11) due to their self pressure, after that, the operation of this pump will also give the mixture a considerable pressure to push it into the agitator (14) through the temperature controller (12). The temperature controller (12) is used for measuring the mixture's temperature and preventing the stability of the mixture caused by an insufficient temperature. In the meantime, the best intake pressure of the agitator is 3.5–5.5 kg/cm$^2$. The stability stressed here means the duration period that keeps the heavy oil and the water at a well mixed conditon. As the oil-water mixture mixed by this invention's method and its installation can last at least four months with only 0.3–1.2% moisture to be escaped, so, its stability is very good.

When the mixture's temperature is insufficient, the temperature controller (12) will order the electro magnetic valve (13) to shut off automatically and let only the heavy oil pass. The reason for doing so is because the water is heated more slowly and the shut off of the water supply will make the temperature rapidly recover to the preselected point, thereby, to be able to prevent damaging the agitation effects. After the temperature gets to the lowest standard 30° C., the electro magnetic valve (13) will be automatically opened for continuation of water supply. When the mixture enters into the agitator (14) through the temperature controller (12) and after agitation by the specially devised stop blades in the agitator, the combustion rate of the mixture can reach 96%. Generally speaking, the combustion rate for 100% pure heavy oil is around 98–99%. Although the mixture made by this invention contains only 80–85% heavy oil, its combustion rate has reached 96%. If we calculate the combustion rate just with 85% heavy oil, it shall be only 90–92%, from which the practical value of this invention can be easily appreciated.

Figure 2:
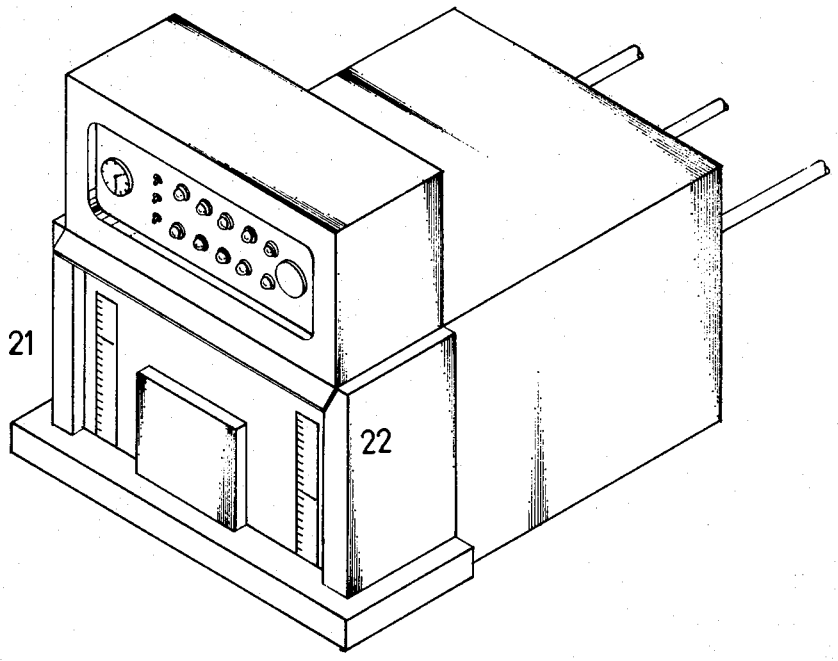
FIG. 2 is a perspective view of the installation system of this invention.

FIG. 2 is a perspective view of installation this invention which shows the oil pressure meter (21) and the water pressure meter (22) can indicate the heavy oil amount and the water amount of this invention at any time, with which we can see whether the internal successive system is normally operated. When contrasting the respective successive mechanisms shown in FIG. 1, the whole actual transmission situation will be clarified. The water inlet pipe (1) is connected to the water tank (2). (17) is a level controller. The water enters into the mixture conveying pipe (7) through the water conveying pipe (9). The oil inlet pipe (4) is connected to the oil tank (5). The heavy oil enters into the mixture conveying pipe (7) through the oil conveying pipe (10). The mixture will pass through the gear pump (11) and the temperature controller (12). The mixture passed through the pump (11) will enter into the agitator (14) for agitation, after that, it will successively enter into the boiler through the outlet pipe (15).

Figure 3:
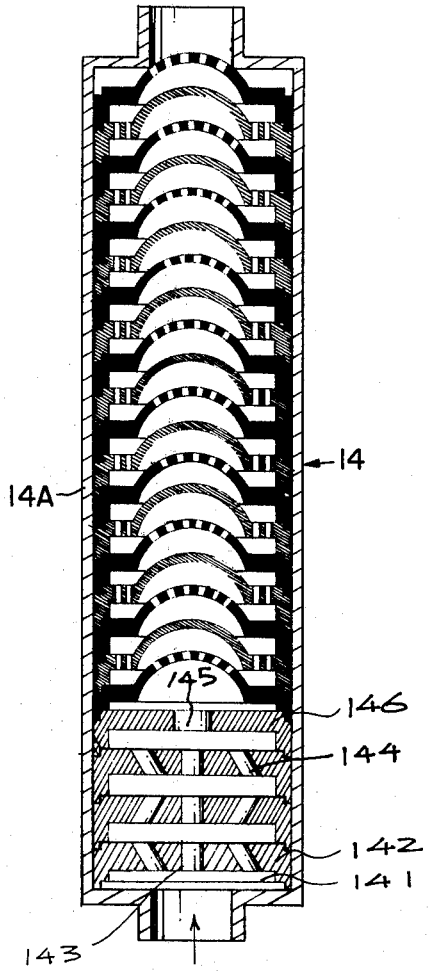
FIG. 3 is an axial section of the agitator of the installation.
Figure 4:
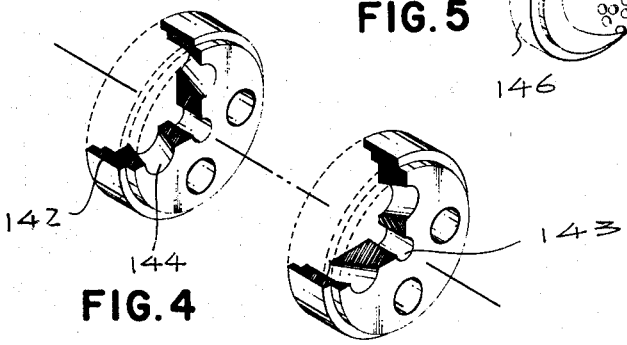
FIG. 4 is an exploded perspective view of two stop blades in the front half of the agitator.

FIG. 3 is a sectional view of the agitator (14) shown in chart of FIG. 1. The agitator (14) comprises a cylindrical casing (14A), in the front half of which is a set of stop blades with four pieces as one set. The lower section of each stop blade is a hollow portion (141), and its upper section is a solid portion (142). Further, there is a small hole (143) at the central point of the first three stop blades' solid portion and there are four additional inclined holes (144) with the same diameter being set around it at an equal interval. Of the inclined holes (144) of the first three stop blades, the corresponding holes for every two adjacent stop blades are designed to be different. The difference is seen from FIG. 4, the exploded perspective view of the stop blades at the front half of the agitator. The purpose of this device is making the mixture produce a whirl agitation at the first stop blade in the beginning as it enters into the agitator by the pump's operation. The whirlpool produced at the central hole will whirl the mixture to enter into the second stop blade through the four inclined holes of the first stop blade, naturally, a part of mixture will flow into the second stop blade through the central hole. When the mixture enters into the second stop blade, the whirlpool will happen again at the second stop blade but in the opposite direction and make the mixture enter into the third stop blade through the central hole and the four inclined holes in the second stop blade. When the mixture is at the third stop blade, it will successively enter into the fourth stop blade in the same way. As the fourth stop blade has only a larger hole (145) at its center, the mixture will be gathered again and enter into the protruding stop blades (146) at the back half of the agitator for a further agitation process.

Figure 5:
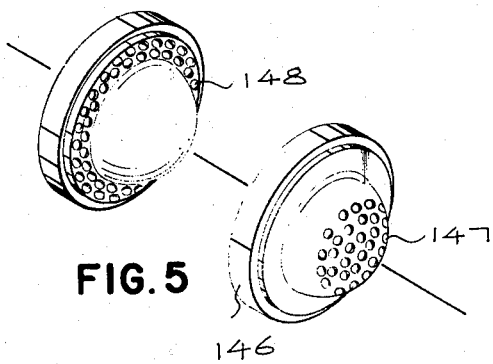
FIG. 5 is an exploded perspective view of two protruding stop blades in the back half of the agitator.

As indicated in FIG. 3, the protruding stop blades (146) at the back half of the agitator are 19 pieces in totality. Each of the stop blades in the back half of the agitator has a central protruding dome portion and a peripheral rim portion. Further, from FIG. 5 it is seen that these stop blades are designed in two different types, one is designed to have numerous small holes (147) in the protruding dome surface, and another is designed to have small holes (148) spread over the rim around the protruding portion. The purpose of this device is making every two adjacent stop blades have different agitation process and every two adjacent stop blades form an agitation system. When the mixture has been agitated by the stop blades at the front half of the agitator and enters into the first stop blade at the back half of the agitator, the whirlpool will still happen at the hollow portion of the protruding dome and make the mixture enter into the second stop blade through the small holes over the protruding surface. After that, the mixture will enter into the third stop blade, which has the same structure as the first stop blade, through the small holes spread over the rim of the second stop blade. When the same action is repeated till the nineteenth stop blade, the condition of the oil-water mixture has become excellent. In this respect, the mixture can be conveyed into the boiler through the conveying pipe for combustion and the whole agitation process is completed.

Regarding the 19 pieces of stop blades situated at the back half of the agitator, it is noted that the number of holes is gradually reduced from 125 holes to 70 holes. In view of the fact that the pressure will be low when the mixture passes through the stop blade with more holes, therefore, the device that gradually reduces the hole number from 125 to 70 is purposed to gradually increase the impact force. Further, the hole number from 70 to 125 has been found by experiment to be the best choice. Considering that this agitator is designed to make the mixture produce the biggest impact force and agitation distance in a fixed space and time, it is concluded that the best pressure born by the agitator is 4–6 kg/cm$^2$. Subject to the pressure situation and the factory's requirement, the hole diameter is usually designed to be 1.5–2.5 mm.

After the mixture is agitated by the above mentioned process, it will form a suspension of water in oil. As the boiling point and the vaporizing point of the water are different from the oil's, the water will become expanded and vaporized when the temperature rises to a certain point, and it will force the oil envelope to break into many very small oil droplets (about 1–5 μm diameter), which is referred to as a break-up. By putting 5 μm of water droplets in 10 μm of oil envelopes, the break-up temperature for the oil envelope is about 200°–250° C.

Figure 6A:
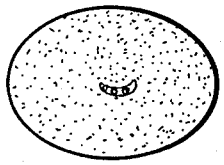
FIGS. 6A, 6B and 6C are microscopic views illustrating the break-up during the combustion of the oil-water mixture.
Figure 6B:
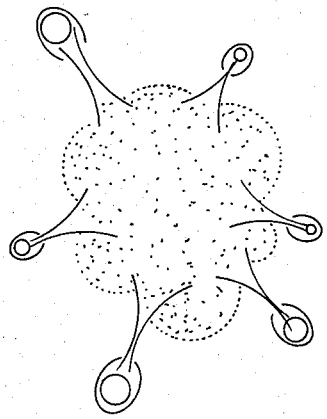
Figure 6C:
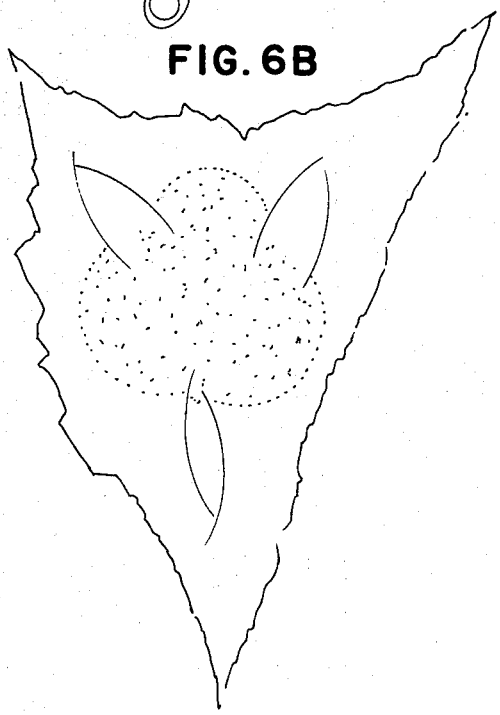

FIGS. 6A to 6C show a micrographic break up (By V. M. Ivanov-Scientist), in which FIG. 6A: Microscopic water droplets in Mazut envelope FIG. 6B: Injection of Mazut particles FIG. 6C: Combustion during breakup of emulsion.

The particles caused by the break-up are much smaller than the particles made by a vaporizer, and its vaporizing effect can not be reached by conventional mechanisms.

In this case the space for the combustion will be certainly increased and the combustion will be more complete, meanwhile, the combustion rate for the broken oil droplets is also largely elevated. The following table shows an experimental comparision between the pure heavy oil and the water-oil mixture with 30% moisture.

| Description | Moisture | Diameter for oil envelope (m/m) | Combustion temp. at the central point. | Time required for oil envelope's combustion |
|---|---|---|---|---|
| Pure heavy oil | 0.4% | 2.8 | 800° C. | 3.74 sec. |
| Water-oil | 30% | 2.8 | 800° C. | 2.8 sec. |

From the above table, it is seen that the break-up is good for the combustion, in that the combustion will be more rapid and complete, also, degree of the air pollution will be reduced and less black smoke will happen upon combustion. The combustion experimental indexes can be seen from the following table:

| Material for air pollution | Pure heavy oil | Water-oil (with 40% moisture) |
|---|---|---|
| Co | 2.8% | 1.15% |
| Co2 | 13.2% | 6.5% |
| So2 | 5.2% | 2.0% |
| N2 | 26.5% | 22.36% |
| NO2 | 21.3% | 9.0% |
| Black smoke | 4.5BOSCH | 0.3BOSCH |

In summarizing the above mentioned, the method and the installation of this invention are a continuous agitation with automatic control to mix "oil" and "water", which needs not the complicated personal operation nor the addition of any emulsifiers (a surface contact agent being used for mixing the oil and the water). It can be mixed directly and the ratio can reach to 40–50%. However, according to the experiment, the ratio of mixing 15–20% water to the oil will get the best combustion rate. Herewith, the characteristic comparison between the water-oil and the pure heavy oil will be listed as follows:

| DESCRIPTION | MOISTURE | SPECIFIC GRAVITY | VISCOSITY | CALORIFIC VALUE | FLAME TEMP. |
|---|---|---|---|---|---|
| pure heavy oil | 0.4% | 0.906 | 610 | 18746 | 1100–1600 |
| water-oil A | 10% | 0.916 | 613 | 17636 | 1100–1600 |
| water-oil B | 20% | 0.925 | 703 | 16120 | 1100–1600 |
| water-oil C | 30% | 0.934 | 803 | 15920 | 1100–1550 |

The saving degree:
Water-oil A 17636 − (18746 × 90%) = 17636 − 16871 = 7646
7646 + 18746 = 4.08%
Water-oil B 16120 − (18746 × 80%) = 16120 − 14996.80 = 1123.20
1123.20 + 18746 = 5.99% ~ 12%
Water-oil C 15920 − (18746 × 70%) = 15920 − 13122.20 = 2797.80
2797.8 + 18746 = 14.92%

As proved by experiments, the said saving ratio concerns the combustion rate of the original equipments (in inverse ratio relation), that is, the lower the efficiency of the original equipment is, the higher the saving ratio is.

In one word, this invention relates to an oil-water mixing method and its installation, which can continuously supply the boiler and elevate the combustion rate. Further, its integrated supply and conveying system is indeed an invention with very practical value. Still further, by the present principle, this oil-water mixing method and its installation, with the ratio of mixing changed if need be, can be also used for other liquid mixtures.

Although we have described this invention in detail with reference to a preferred embodiment, it will be understood that this is by way of example.

We claim:

1. An installation for continuously and automatically producing an oil-water mixture comprising:

a water tank having means for maintaining water in said tank at a selected temperature and pressure, an oil tank having means for maintaining oil in said tank at a selected temperature and pressure, an agitator for intimately mixing water from said water tank and oil from said oil tank, said agitator having an inlet and an outlet, pump means having an inlet connected with said water tank and said oil tank and an outlet connected with the inlet of said agitator and operable to supply oil and water under pressure to said agitator, and means for controlling the temperature of the oil and water supplied under pressure by said pump means to said agitator, said agitator comprising a casing having an inlet and an outlet and containing a first set of static elements for producing a swirling motion of oil and water forced through them by said pump and a second set of static elements having a multiplicity of small holes through which said oil and water are forced and thereby intimately mixed with one another.

2. An installation according to claim 1, including an oil-water mixture outlet leading from the outlet of said agitator to an oil burner, a first line including a first valve leading from an oil supply to said oil tank and a second line including a second valve connecting said first line up-stream of said first valve with said oil-water mixture outlet, said second valve being normally closed and said first valve being normally open to supply oil to said oil tank, and said first valve being closed and said second valve being opened to supply oil directly to said oil-water mixture outlet.

3. An installation according to claim 1, in which the connection of said pump with said water tank comprises a line including a valve operable under control of said means for controlling the temperature of said oil and water supplied under pressure by said pump to said agitator to shut off the water in the event the temperature of said oil and water falls below a predetermined value.

4. An installation according to claim 1, in which said casing of said agitator is cylindrical with said inlet at one end and said outlet at the opposite end, and in which said elements comprise disc-like members stacked in said casing.

5. An installation according to claim 4, in which said elements of said first set have a hollow on the up-stream side and a central hole, all except the last of said elements having also a plurality of inclined holes arranged around said central hole to produce a swirling motion of oil-water passing therethrough.

6. An installation according to claim 1 or claim 5, in which each of said elements of said second set has a central dome portion surrounded by a rim portion, alternate ones of said domed elements having said small holes in said domed portion and intervening elements having said small holes in said rim portion.

7. An installation according to claim 6, in which the number of holes in said elements of said second set progressively decreases from said inlet to said outlet.

8. An agitator for mixing two immiscible liquids comprising a cylindrical casing having a liquid inlet at one end and a liquid outlet at the opposite end, a first set of disc-like elements in said casing in an inlet end portion thereof, each of said elements having a hollow on the up-stream side thereof and a central hole through the element and each of said elements except the last in the direction of flow having also a plurality of inclined holes arranged around said central hole, and a second set of disc-like elements down stream of said first set, each of said second set of elements having a central protruding dome portion surrounded by a rim portion, alternate elements of said second set having a multiplicity of small holes only in said dome portion and intervening elements of said second set having a multiplicity of small holes only in said rim portion.

9. An agitator according to claim 8, in which said inclined holes of adjacent elements of said first set are inclined in different directions.

10. An agitator according to claim 8, in which the number of holes in said elements of said second set progressively decreases in the direction of liquid flow.

11. A method of supplying a stable mixture of heavy oil and water to an oil burner comprising the steps of:

supplying water to a water tank and maintaining water in said water tank at a selected temperature and pressure, supplying heavy oil to an oil tank and maintaining oil in said oil tank at a selected temperature and pressure, pumping water from said water tank and oil from said oil tank under pressure into an agitator while controlling the temperature of the oil and water pumped into said agitator, and forcing oil and water through said agitator by said pump, said agitator comprising a cylindrical casing having at one end an inlet connected with said pump and at the other end an outlet connected with said oil burner, a first set of static elements in said casing adjacent said inlet and a second set of static elements in said casing between said first set and said outlet, elements of said first set having inclined holes therethrough to produce a swirling motion of liquid forced therethrough by said pump and elements of said second set having selected areas perforated with a multiplicity of small holes, the perforated areas of adjacent elements of said second set being offset from one another, the oil and water forced through said agitator being thereby intimately mixed to perform a stable mixture which is delivered to said oil burner.

12. A method according to claim 11, in which the temperature of water in said water tank is maintained between 30° and 40° C., the temperature of heavy oil in said oil tank is maintained between 35°–45° C. and the temperature of oil-water pumped into said agitator is maintained above 30° C.

13. A method according to claim 11, in which the pressure at which said oil-water is pumped into said agitator is between 3.5 and 5.5 $Kg/cm^2$.

14. A method according to claim 11, in which oil and water are pumped into said agitator in the proportion of 80–85% of heavy oil and 20–15% water.

* * * * *